US009420899B2

(12) United States Patent
Merlo

(10) Patent No.: US 9,420,899 B2
(45) Date of Patent: Aug. 23, 2016

(54) HIGH-CHAIR WITH TRAY EASILY CONNECTABLE TO SUPPORT LEGS OF ITS STRUCTURE WHEN THE TRAY IS NOT IN USE

(71) Applicant: ARTSANA S.P.A., Grandate (IT)

(72) Inventor: Mario Merlo, Grandate (IT)

(73) Assignee: ARTSANA S.P.A., Grandate (IT)

( * ) Notice: Subject to any disclaimer, the term of this patent is extended or adjusted under 35 U.S.C. 154(b) by 0 days.

(21) Appl. No.: 14/426,624

(22) PCT Filed: Aug. 8, 2013

(86) PCT No.: PCT/IB2013/056489

§ 371 (c)(1),
(2) Date: Mar. 6, 2015

(87) PCT Pub. No.: WO2014/037827

PCT Pub. Date: Mar. 13, 2014

(65) Prior Publication Data

US 2015/0216320 A1 Aug. 6, 2015

(30) Foreign Application Priority Data

Sep. 7, 2012 (IT) ..... MI20120321 U

(51) Int. Cl.
*A47D 1/00* (2006.01)

(52) U.S. Cl.
CPC ..... *A47D 1/008* (2013.01)

(58) Field of Classification Search
CPC ..... A47D 1/008
USPC ..... 297/153, 154
See application file for complete search history.

(56) References Cited

U.S. PATENT DOCUMENTS

| | | | | |
|---|---|---|---|---|
| 2,699,817 A * | 1/1955 | Adler | A47D 1/02 297/153 |
| 3,649,074 A * | 3/1972 | McDonald | A47D 1/002 297/153 X |
| 5,660,432 A | 8/1997 | Davis | |
| 7,029,064 B2 * | 4/2006 | Chen | A47D 1/02 297/16.1 |

FOREIGN PATENT DOCUMENTS

| | | |
|---|---|---|
| CN | 201929503 U | 8/2011 |
| CN | 202035808 U | 11/2011 |
| GB | 2 414 388 A | 11/2005 |

* cited by examiner

*Primary Examiner* — Anthony D Barfield
(74) *Attorney, Agent, or Firm* — Pearne & Gordon LLP

(57) ABSTRACT

A high-chair including a support structure for a seat adapted to contain a child, the structure having a pair of front legs and a pair of rear legs, the seat having arm rests to which a tray is removably coupled, the tray being able to be associated, when not in use, with the rear legs of the structure. The tray includes movable coupling elements arranged to cooperate with counter-elements associated with the legs, the coupling elements being movable within respective seats provided in the tray against the action of a corresponding elastic thrust element, this enabling rapid snap-coupling of the elements and counter-elements when brought into a facing position.

12 Claims, 6 Drawing Sheets

HIGH-CHAIR WITH TRAY EASILY CONNECTABLE TO SUPPORT LEGS OF ITS STRUCTURE WHEN THE TRAY IS NOT IN USE

The present invention relates to a children's high-chair in accordance with the introduction to the main claim.

A usual high-chair is known to comprise a support structure for a seat, said structure comprising a pair of spaced-apart arm rests arranged to removably support a tray. Said tray can be easily used to support toys or plates or cups for feeding a child positioned in the seat.

It is known to separate this tray, for example to enable the child to be brought close to a table. In that case, it is also known to associate said tray with the high-chair rear legs, to enable it to be always maintained associated with the high-chair structure when not in use. For this purpose, different methods are available for coupling the tray to said legs, methods which however present various problems, for example related to the possible separation of the tray from said legs when the high-chair is moved, or the difficulty of coupling said tray to the legs.

An object of the present invention is to provide a high-chair presenting a removable tray which can be easily coupled to the high-chair legs when separated from the high-chair.

Another object is to provide a high-chair of the stated type having a tray which is easy to couple to and separate from the high-chair.

Another object is to provide a high-chair the tray of which is of simple construction and use.

These and other objects which will be apparent to the expert of the art are attained by a high-chair in accordance with the accompanying claims.

The present invention will be more apparent from the accompanying drawings, which are provided by way of non-limiting example and in which.

With reference to said figures, a high-chair is indicated overall by 1 and comprises a structure 2, preferably foldable, supporting a seat 3 in known manner. The structure comprises a pair of front legs 4 and 5 and a pair of rear legs 6 and 7, the legs 4 and 5 slidingly supporting the seat 3 in known manner, which can hence be positioned at different heights along said legs 4 and 5 from a support surface for the high-chair.

Figure 1:
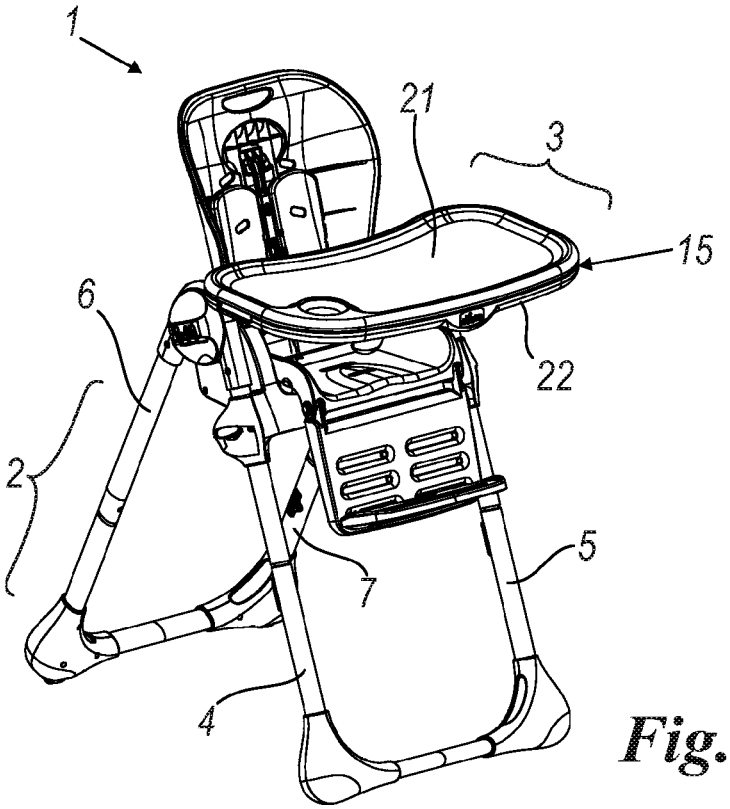
FIG. 1 is a perspective view of a high-chair according to the invention with a tray in its position of use.

The seat 3, of known type, comprises two arm rests 11 and 12 positioned spaced-apart and adapted to support a tray 15 which can assume a working position (FIG. 1) in which it is associated with said arm rests (FIG. 1) and a rest or "put-away" position (FIG. 2) in which it is associated with the rear legs 6 and 7 of the structure 2.

More particularly, the tray 15 comprises a body 20 having an upper surface 21 and a lower surface 22. These surfaces pertain to corresponding portions 23 and 24 of the body 20, they being coupled together in known manner to define an internal cavity 26 of the tray 15. Two pairs 28 of shoulders 29 and 30 branch from the lower surface 22 of the tray to define a seat 31 for the corresponding arm rest which is relatively disposed in this seat when the tray is in its position of use. Coupling elements 36 project from a wall 32 of the shoulder 30 of each pair of shoulders 27, to cooperate with seats 37 provided in the corresponding arm rest 11 or 12, to hence enable the tray 15 to be fitted to these latter.

Figure 2:
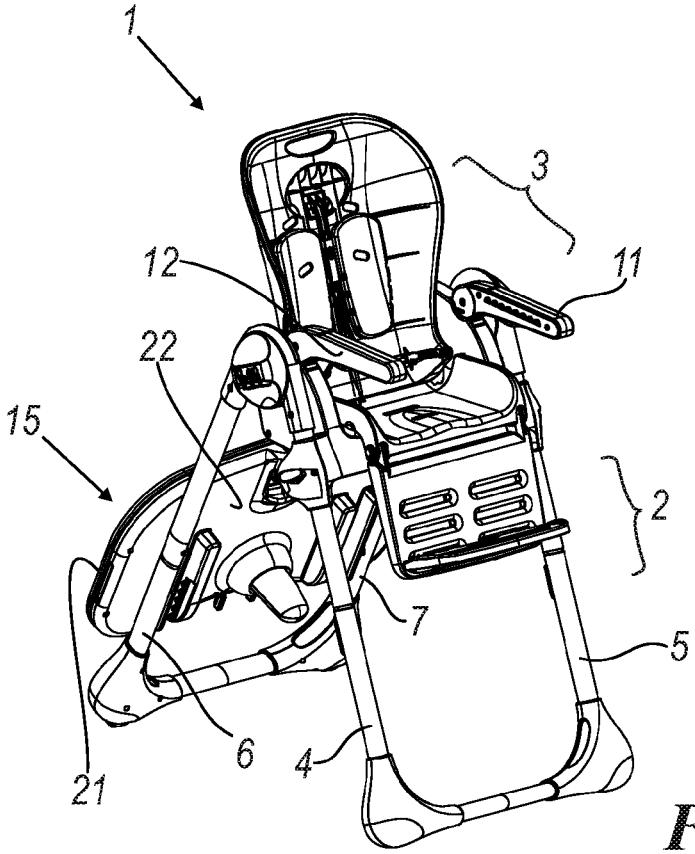
FIG. 2 is a perspective view of a high-chair with the tray in its separated non-use position.

At least one coupling element 41 projects from a seat 40 of the shoulder 29 of each shoulder pair 28 on a side 29A thereof external to the seat 31, and is movable within said seat 40 to cooperate with a counter-element or recess 42 made in a corresponding rear leg 6 and 7 of the structure 2 of the high-chair 1, to enable the tray to be coupled to these latter when not in use (see FIG. 2).

At least the coupling elements 41 and preferably and advantageously also the coupling elements 36 are associated with corresponding supports 45 inserted into the cavity 26 of the tray 15 and translating on the portion 24 under the guidance of lateral shoulders 47 and 48 and of a central shoulder 49 of C-shaped cross-section. More particularly, each support 45 has a substantially hollow (at 56) annular shape of rectangular perimeter. Recesses 50 are provided in opposing lesser-length sides 49A, 49B in the support 45, into which the shoulders or projections 47, 48 jutting from the portion 24 in said cavity 26 are inserted. These projections laterally guide the movement of the support 45 along a face 54 of the portion 24 inside the cavity 26.

Each support also presents two projecting parts 60 and 61 on the two major-length sides 57 and 58. The projecting part 60 defines a recess 60A, open towards the interior of the support 45, which houses a first end 63 of a spiral spring 64 the other end of which is inserted into the C-shaped shoulder 49 open towards the part 60. This shoulder 49, rising from the face 54 of the portion 24, is of lesser width than the recess 60A and can penetrate into this latter following a movement of the support 45 on the face 54 of the portion 24, this translatory movement being guided by said projections 47, 48 and by the part 60 itself.

Figure 3:
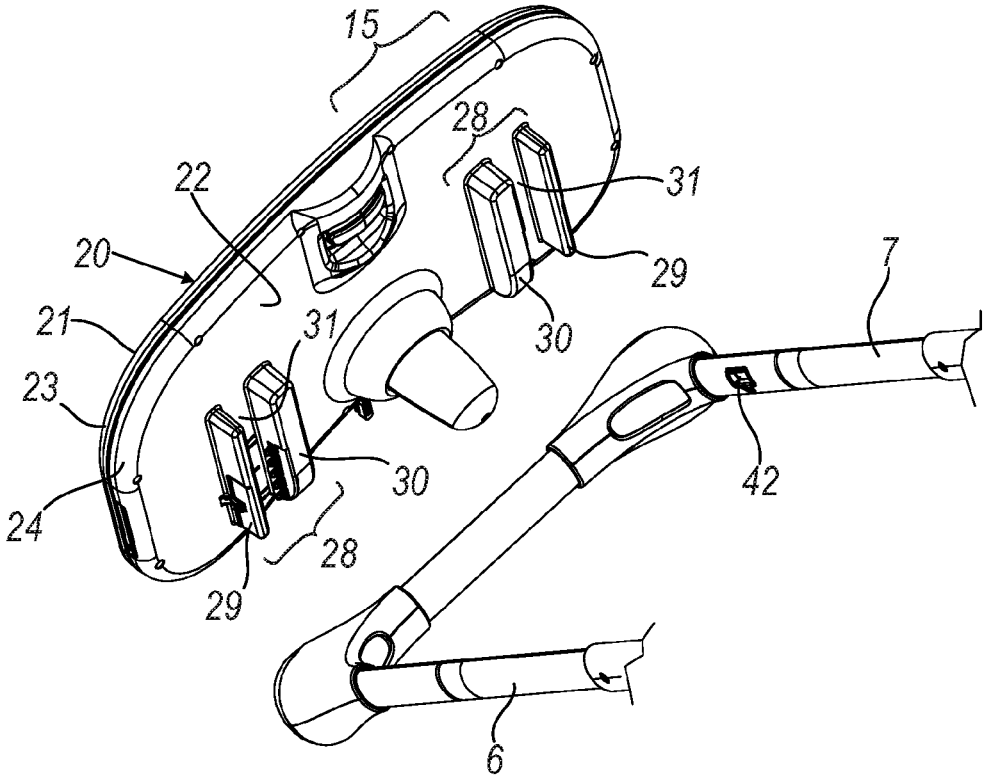
FIG. 3 is a perspective view showing the step of coupling the tray of FIG. 2 to the high-chair structure.
Figure 4:
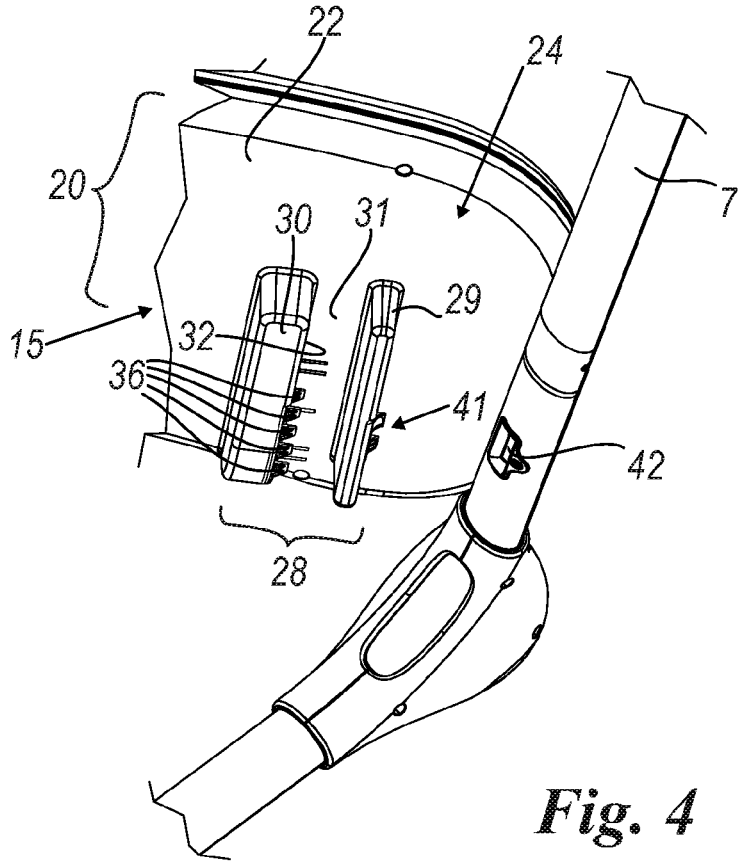
FIG. 4 is a partial perspective near view of a part of the high-chair during its coupling to the tray.

The other projecting part 61 of the support 45 extends outwards from this latter and presents a projection 70, mounted on which there is the end 71 of a flexible element 72 (inserted in a channel 90) rigid with a handle 73 slidingly associated with the tray 15 and movable therein in a guided manner (by pins 75 inserted into a recess or slot 76 of the handle 73 from the face 54). The handle projects from the lower surface 21 of the tray 15 in grippable manner (see FIG. 3).

Figure 5:
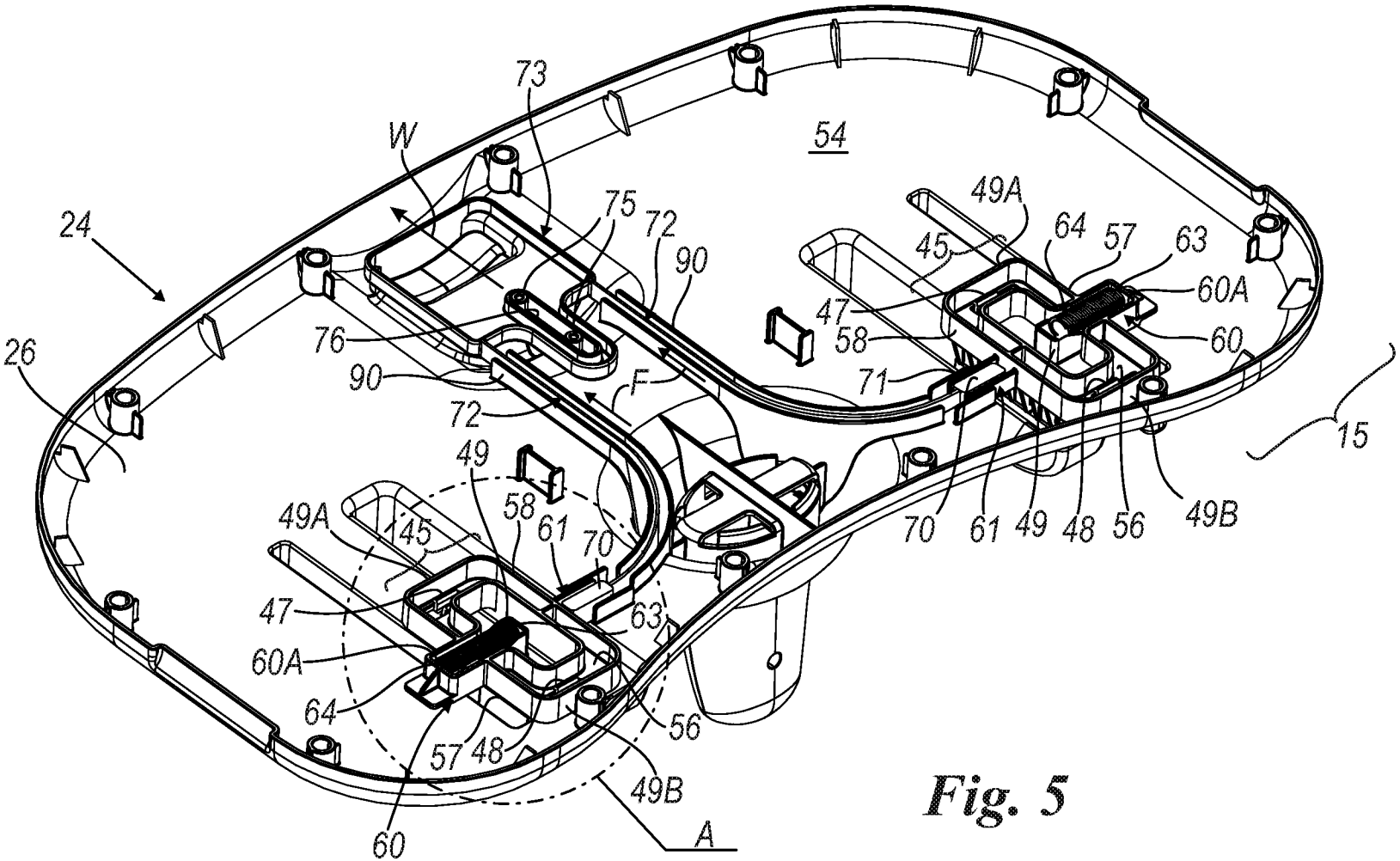
FIG. 5 is a perspective view of the tray of the high-chair of FIG. 1 seen from above, with a part removed for greater clarity.
Figure 6:
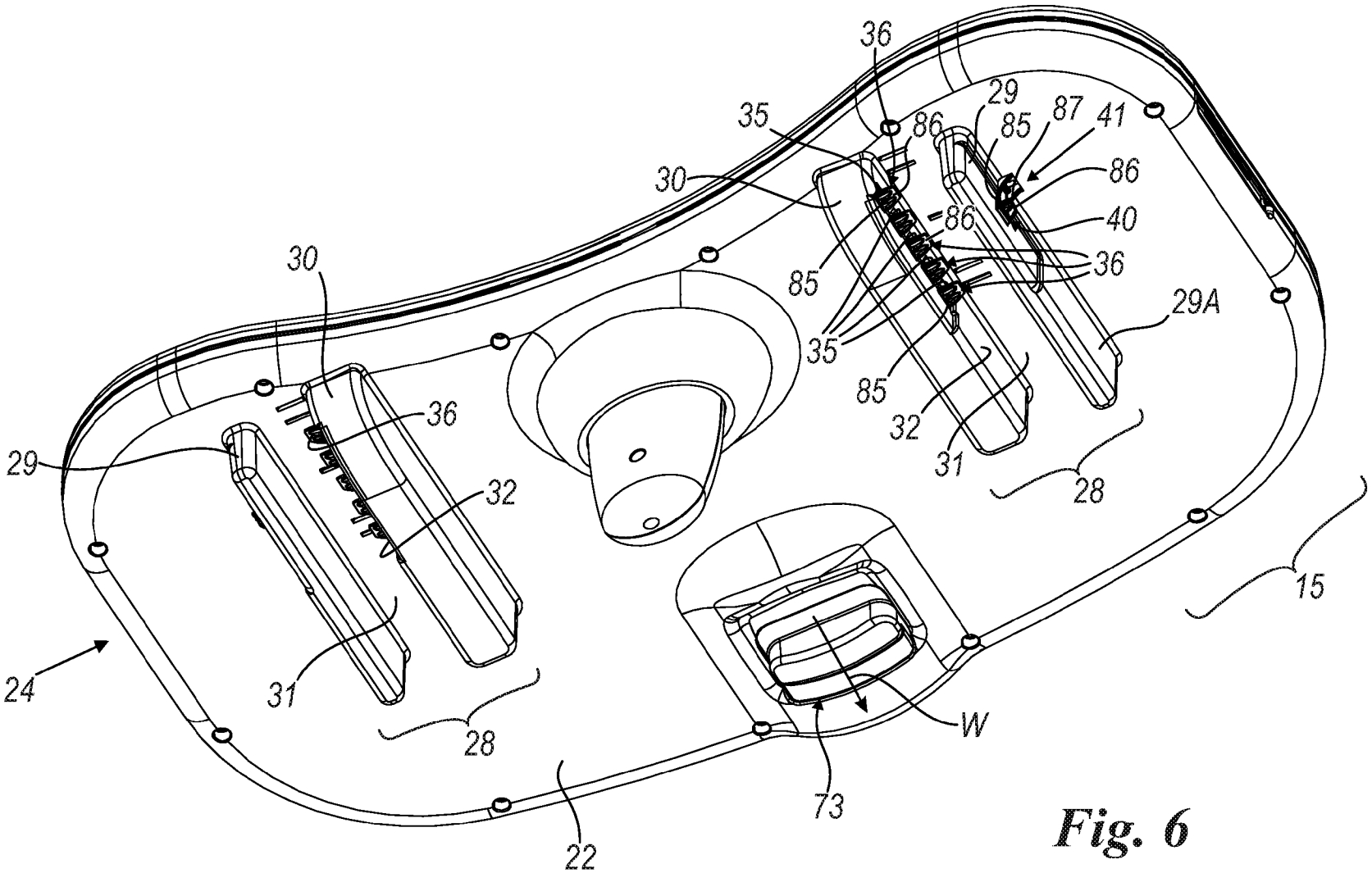
FIG. 6 is a perspective view of the tray of FIG. 5 seen from below.
Figure 7:
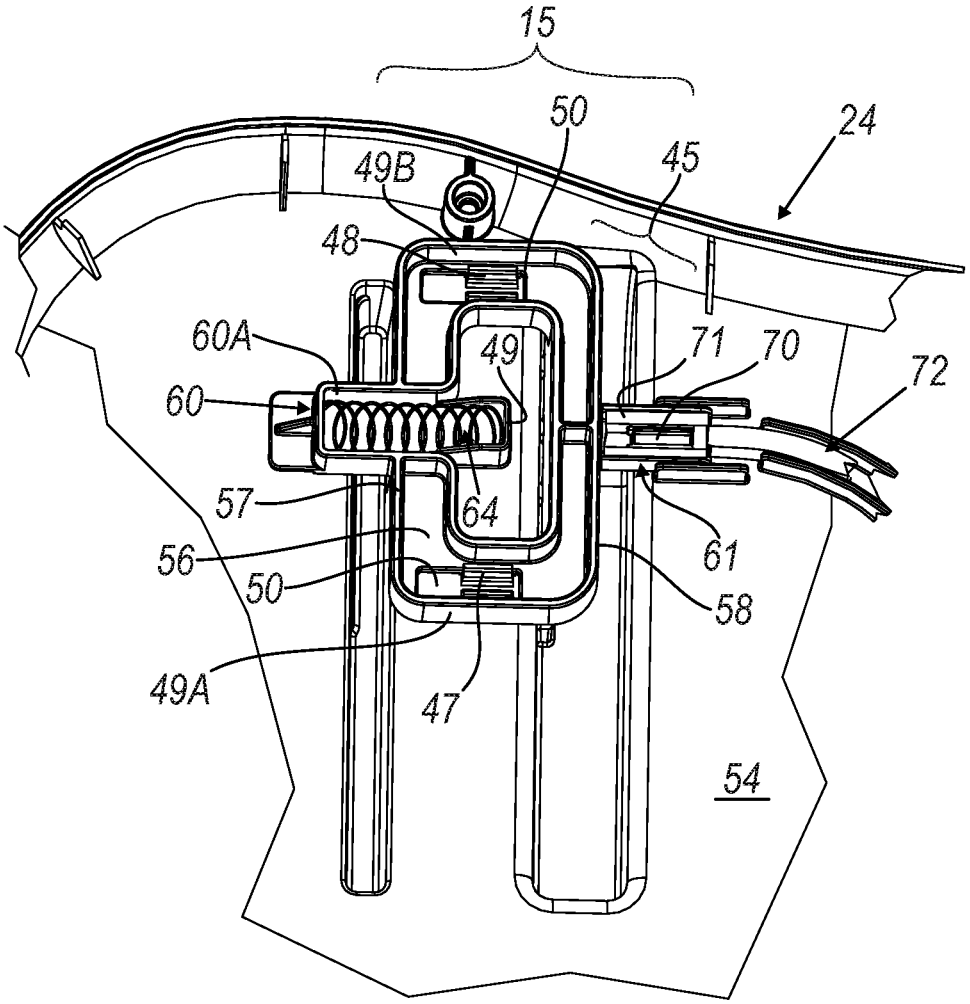
FIG. 7 is an enlarged view of a part indicated by A in FIG. 5.
Figure 8:
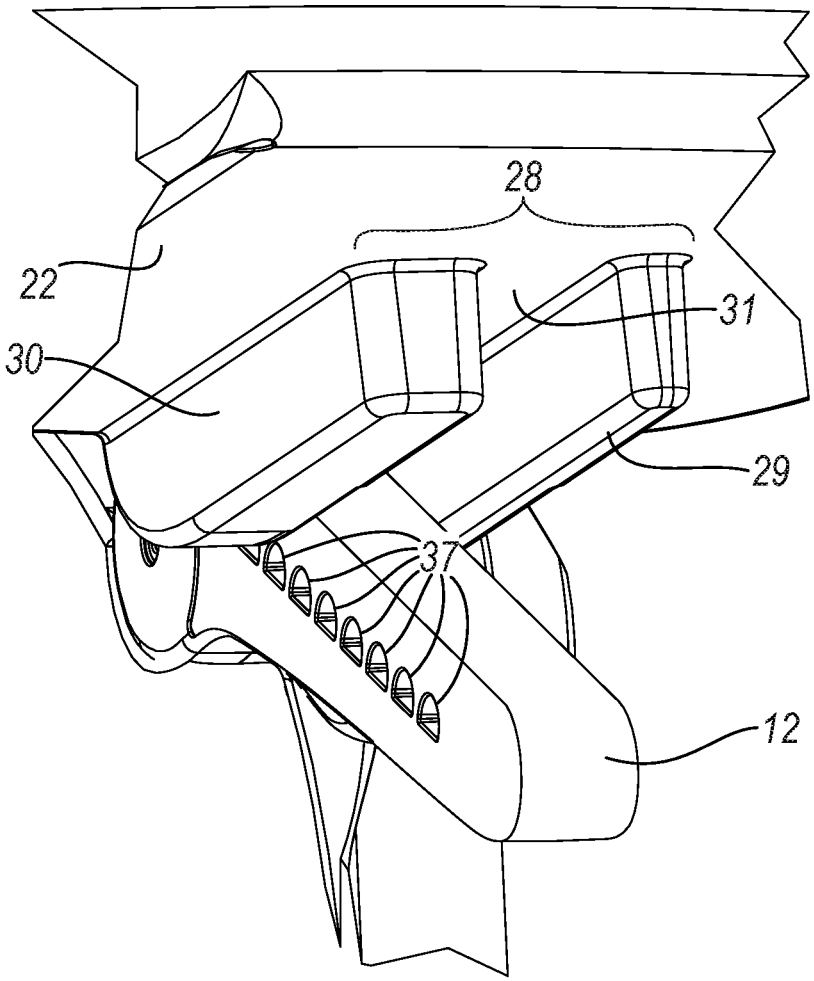
FIG. 8 is a partial perspective view of the tray during its coupling to the high-chair into its position of use.

The movement guided by the handle relative to the pins 75 enables the supports 45 to be moved (by pulling the flexible elements or linkages 72, see arrow F in FIG. 5) against corresponding springs 64 and hence cause the coupling elements 36 and 41 rigid with said supports to enter the corresponding seats. On releasing the handle, said elements again leave the respective seats as the springs 64 urge the supports into their rest position (in which these elements project from the seats). In this manner, by applying a traction force (arrow W of FIGS. 5 and 6) to the handle 73, the coupling elements 36 leave the seats 37 of the arm rests while the tray 15 is in cooperation with these latter, so that it can overcome them and be associated with the legs 6 and 7. Vice versa, when the tray is in this rest position, operating the handle 73 (arrow W) causes the elements 41 to emerge from the recesses 42 of the legs 6 and 7, enabling the tray to be separated from them and be associated with the arm rests.

It should be noted that the (movable) elements 36 and 41 present, when at rest (i.e. with the supports 45 thrust to their limit position by the springs 64), a portion 85 projecting from the corresponding seat 40 and 35 (respectively) and having a shape which tapers towards a free end 86, with its inclined surface extending towards the lower surface 22 of the tray 15. This portion also comprises a flat zone 87 terminating at said end 86 which faces and is substantially parallel to the surface 22. This means that when the tray is rested on the legs 6 and 7 with the elements 41 at the recesses 42 or close to them (by being slid along these legs as far as the recesses), these elements enter their seats 40 by being relatively thrust by the legs 6, 7 which slide relative thereto on the inclined surface portions 85; this is achieved without operating the handle 73. When these elements have completely (or substantially totally) entered said seats, they can be moved exactly in front of the recesses 42 such that they can enter these latter.

This movement of insertion into said recesses takes place totally automatically by virtue of the presence of the springs 64 acting on the supports 45.

This occurs in the same manner for the elements 36 with regard to the seats 37. The arrangement of these latter along each arm rest enables the position of the tray 15 to be adjusted along it, such as to approach the child seated in the seat to a lesser extent.

In the same manner, with the elements 36 inserted in the seats 37 or with the elements 41 inserted in the recesses 42, the tray 15 can be separated from the arm rests 11, 12 or from the legs 6 and 7 of the structure 2, respectively. This is achieved by forcing (or pulling) the tray away from the structure (with one or two hands); this action and the relative action of the arm rests or of the legs on the movable elements 36 and 41 causes these latter to enter the respective seats against the action of the corresponding springs and enables the tray 15 to be separated from the structure 2.

The invention is very easy to use, as is apparent from the aforegoing, and is of simple construction. It presents a small number of components, enabling product costs to be reduced.

A preferred embodiment of the invention has been described. Others are however possible and are to be considered as falling within the scope of the invention.

The invention claimed is:

1. A high-chair comprising a support structure for a seat adapted to contain a child, the structure having a pair of front legs and a pair of rear legs, the seat having arm rests to which a tray is removably coupled, said tray being able to be associated, when not in use, with the rear legs of the structure, characterised in that the tray comprises movable coupling elements arranged to cooperate with counter-elements associated with the rear legs, said coupling elements being movable within respective seats provided in the tray against the action of a corresponding elastic thrust element, this enabling rapid snap-coupling of said elements and counter-elements when brought into a facing position, wherein the coupling counter-elements are recesses formed in the rear legs of the structure.

2. A high-chair as claimed in claim 1, characterised in that said movable coupling elements are carried by first shoulders of pairs of shoulders rising from a lower surface of the tray, said shoulders of said pairs defining a seat for a corresponding arm rest.

3. A high-chair as claimed in claim 2, characterised in that second shoulders of said pairs of shoulders carry movable coupling elements arranged to cooperate with seats provided in the arm rests, this cooperation coupling the tray to these latter.

4. A high-chair as claimed in claim 3, characterised in that each movable coupling element presents, when these are at rest, a portion projecting from the corresponding seat with a shape which tapers towards a free end or represents an inclined plane extending towards the lower surface of the tray, said portion having a flat zone which terminates at said end and which extends towards and is substantially parallel to said surface.

5. A high-chair as claimed in claim 1, characterised in that each movable coupling element presents, when these are at rest, a portion projecting from the corresponding seat with a shape which tapers towards a free end or represents an inclined plane extending towards a lower surface of the tray, said portion having a flat zone which terminates at said end and which extends towards and is substantially parallel to said surface.

6. A high-chair as claimed in claim 1, characterised in that said coupling elements are carried by corresponding supports positioned in the interior of the tray and guidedly movable within it, said supports being connected to a handle associated with the tray and operable from the outside of it.

7. A high-chair as claimed in claim 6, characterised in that said supports also carry the coupling elements for coupling the tray to the arm rests of the high-chair structure.

8. A high-chair as claimed in claim 6, characterised in that the tray is defined by two portions coupled together to define a cavity internal to the tray, the supports for the movable coupling elements being located in this cavity.

9. A high-chair as claimed in claim 8, characterised in that shoulders project from a face of a first tray portion inside said cavity, to guide the corresponding supports in a translatory movement when operated by the handles between one of these shoulders and the relative support, a spring defining the elastic thrust element being positioned to oppose the movement of said support when operated by the handle.

10. A high-chair as claimed in claim 6, characterised in that the handle is connected to each support by a flexible element inserted into a corresponding channel rigid with the tray.

11. A high-chair as claimed in claim 6, characterised in that the handle is guidedly movable within the tray cavity.

12. A high-chair as claimed in claim 11, characterised in that guide elements rise from a face of the first tray portion inside the tray cavity and are inserted into a slot of the handle, to guide the movement of this latter.

* * * * *